US008850865B2

(12) United States Patent
Miyasaka et al.

(10) Patent No.: US 8,850,865 B2
(45) Date of Patent: Oct. 7, 2014

(54) DIE CUSHION DEVICE

(75) Inventors: Takuji Miyasaka, Komatsu (JP); Hirohide Sato, Komatsu (JP); Shigeo Morimoto, Yokohama (JP); Hiroyuki Ito, Yokohama (JP); Takeo Arikabe, Hiratsuka (JP); Shyoji Watanabe, Komatsu (JP); Shigenori Nagashima, Komatsu (JP)

(73) Assignees: Komatsu Ltd., Tokyo (JP); Komatsu Industries Corporation, Ishikawa (JP)

( * ) Notice: Subject to any disclaimer, the term of this patent is extended or adjusted under 35 U.S.C. 154(b) by 369 days.

(21) Appl. No.: 12/989,451

(22) PCT Filed: May 7, 2009

(86) PCT No.: PCT/JP2009/058636

§ 371 (c)(1),
(2), (4) Date: Oct. 25, 2010

(87) PCT Pub. No.: WO2009/142112

PCT Pub. Date: Nov. 26, 2009

(65) Prior Publication Data

US 2011/0036140 A1 Feb. 17, 2011

(30) Foreign Application Priority Data

May 22, 2008 (JP) ..... 2008-134819

(51) Int. Cl.
*B21J 9/18* (2006.01)
*B21D 24/10* (2006.01)
*B21D 24/02* (2006.01)

(52) U.S. Cl.
CPC ..... *B21D 24/02* (2013.01); *B21D 24/10* (2013.01)
USPC ..... 72/453.13; 72/351

(58) Field of Classification Search
USPC ..... 72/453.13, 351, 453.01, 453.03
See application file for complete search history.

(56) References Cited

U.S. PATENT DOCUMENTS 4,229,965 A * 10/1980 Spacek et al. ..... 72/453.13
4,796,459 A * 1/1989 Mueller et al. ..... 72/355.2
5,007,276 A * 4/1991 Kadis et al. ..... 72/351
5,027,637 A * 7/1991 Umetsu ..... 72/453.13
5,065,606 A * 11/1991 Kadis ..... 72/348

(Continued)

FOREIGN PATENT DOCUMENTS

JP 4-146876 A 5/1992
JP 8-11000 A 1/1996

(Continued)

OTHER PUBLICATIONS

International Search Report of corresponding PCT Application No. PCT/JP2009/058636.

*Primary Examiner* — Shelley Self
*Assistant Examiner* — Homer Boyer
(74) *Attorney, Agent, or Firm* — Global IP Counselors, LLP

(57) ABSTRACT

A die cushion device includes a cushion pad, a support section, a servomotor, and a shock absorber device. The support section supports the cushion pad. The servomotor raises and lowers the support section for raising and lowering the cushion pad. The shock absorber device includes a damping section and relieves shock between the cushion pad and the support section. The damping section generates reaction force in accordance with the relative speed of the cushion pad with respect to the support section.

5 Claims, 10 Drawing Sheets

(56) References Cited

U.S. PATENT DOCUMENTS

| | | | | | |
|---|---|---|---|---|---|
| 5,065,607 | A | * | 11/1991 | Kadis et al. | 72/351 |
| 5,295,383 | A | * | 3/1994 | Kirii et al. | 72/351 |
| 5,316,273 | A | * | 5/1994 | Vaphiadis | 267/64.24 |
| 5,339,665 | A | * | 8/1994 | Yoshikawa | 72/20.1 |
| 5,361,615 | A | * | 11/1994 | Kirii et al. | 72/19.8 |
| 5,966,981 | A | * | 10/1999 | Janos et al. | 72/350 |
| 7,401,488 | B2 | * | 7/2008 | Baba | 72/351 |
| 7,958,765 | B2 | * | 6/2011 | Baba et al. | 72/350 |
| 8,006,538 | B2 | * | 8/2011 | Iwashita et al. | 72/454 |
| 8,037,735 | B2 | * | 10/2011 | Kohno et al. | 72/453.13 |
| 8,042,375 | B2 | * | 10/2011 | Suzuki | 72/453.13 |
| 8,127,590 | B2 | * | 3/2012 | Kohno et al. | 72/453.13 |

FOREIGN PATENT DOCUMENTS

| | | | |
|---|---|---|---|
| JP | 2006-15407 | A | 1/2006 |
| JP | 2006-55872 | A | 3/2006 |
| JP | 2006-289498 | A | 10/2006 |

* cited by examiner (a)

(b)

CHANGE IN SPEED DIFFERENCE COMMAND VALUE

CHANGE IN LOAD BY ACCUMULATOR AND CHANGE IN TARGET LOAD

DIE CUSHION DEVICE

CROSS-REFERENCE TO RELATED APPLICATIONS

This national phase application claims priority to Japanese Patent Application No. 2008-134819 filed on May 22, 2008. The entire disclosure of Japanese Patent Application No. 2008-134819 is hereby incorporated herein by reference.

TECHNICAL FIELD

The present invention relates to a die cushion device.

BACKGROUND ART

The die cushion devices are installed in the press machines for applying press force to a slide. In the die cushion devices, a cushion pad receives force from the slide moving downwards. Further, the cushion pad is configured to be moved while applying press force to the slide.

In the well-known die cushion devices, a servomotor is caused to drive the cushion pad for highly accurately controlling press force to be applied to the slide. Further, there has been produced a die cushion devices of a type configured to relieve shock in collision between the slide and the cushion pad (see Japan Laid-Open Patent Application Publication No. JP-A-2006-015407). The die cushion device includes a hydraulic chamber disposed between the cushion pad and a support section configured to support the cushion pad. The hydraulic pressure chamber is filled with oil, and the oil can relieve shock acting on the cushion pad.

SUMMARY

In the aforementioned die cushion devices, the oil filled in each hydraulic pressure chamber functions as a spring. The oil can relieve shock in collision and supports the load applied to the cushion pad. The load, applied to the cushion pad, corresponds to the press force applied to the slide. The oil, filled in the hydraulic pressure chamber, is herein regarded as a spring. When a soft spring with a low spring constant is used, the load rises slowly. Therefore, it takes a long time for the load applied to the cushion pad to reach a target load. In other words, it takes a long time for the press force applied to the slide to reach a target press force. When a hard spring with a high spring constant is used, on the other hand, the load rises quickly. However, overshoot and undershoot of vibration are easily produced.

It is an objection of the present invention to provide a die cushion device configured to reduce a rise time of press force applied to a slide.

A die cushion device according to a first aspect of the present invention includes a cushion pad, a support section, a servomotor, and a shock absorber device. The support section supports the cushion pad. The servomotor is configured to raise and lower the support section for raising and lowering the cushion pad. The shock absorber device is configured to relieve shock between the cushion pad and the support section. The shock absorber device includes a damping section. The damping section is configured to generate reaction force in accordance with the relative speed of the cushion pad with respect to the support section.

According to the die cushion device of the first aspect of the present invention, the damping section disposed in the shock absorber device achieves reduction in the rise time of the load in the shock absorber device. Accordingly, the rise time of the press force applied to the slide can be reduced.

A die cushion device according to a second aspect of the present invention relates to the die cushion device according to the first aspect of the present invention. In the die cushion device, the shock absorber device further includes an elastic section. The elastic section is configured to generate reaction force in accordance with a relative displacement of the cushion pad with respect to the support section.

According to the die cushion device of the second aspect of the present invention, the shock absorber device includes both the elastic section and the damping section. Therefore, the elastic section can stabilize the load in the shock absorber device. Further, the damping section compensates slow rising of the load by the elastic section. Accordingly, the rise time of the load can be reduced.

A die cushion device according to a third aspect of the present invention relates to the die cushion device according to the first aspect of the present invention. In the die cushion device, the shock absorber device further includes a liquid pressure chamber and a liquid flow path. The liquid pressure chamber is filled with liquid. The liquid pressure chamber is disposed between the cushion pad and the support section. The liquid flow path allows the liquid to pass therethrough. The liquid flow path is connected to the liquid pressure chamber. Further, the aforementioned damping section is a restrictor disposed in the liquid flow path.

According to the die cushion device of the third aspect of the present invention, the damping section can be formed by connecting both the liquid flow path and the restrictor to the liquid pressure chamber.

A die cushion device according to a fourth aspect of the present invention relates to the die cushion device according to the second aspect of the present invention. In the die cushion device, the shock absorber device further includes a liquid pressure chamber and a liquid flow path. The liquid pressure chamber is filled with liquid. The liquid pressure chamber is disposed between the cushion pad and the support section. The liquid flow path allows the liquid to pass therethrough. The liquid flow path is connected to the liquid pressure chamber. Further, the elastic section is an accumulator disposed in the liquid flow path.

According to the die cushion device of the fourth aspect of the present invention, the elastic section can be formed by connecting both the liquid flow path and the accumulator to the liquid pressure chamber.

Overall, according to the present invention, the damping section disposed in the shock absorber device achieves reduction in a rise time of the load in the shock absorber device. Accordingly, a rise time of the press force applied to the slide can be reduced.

DETAILED DESCRIPTION OF EMBODIMENTS

1. Structure

An exemplary embodiment of the present invention will be hereinafter explained with reference to figures.

1-1. Overall Structure of Press Machine 1

Figure 1:
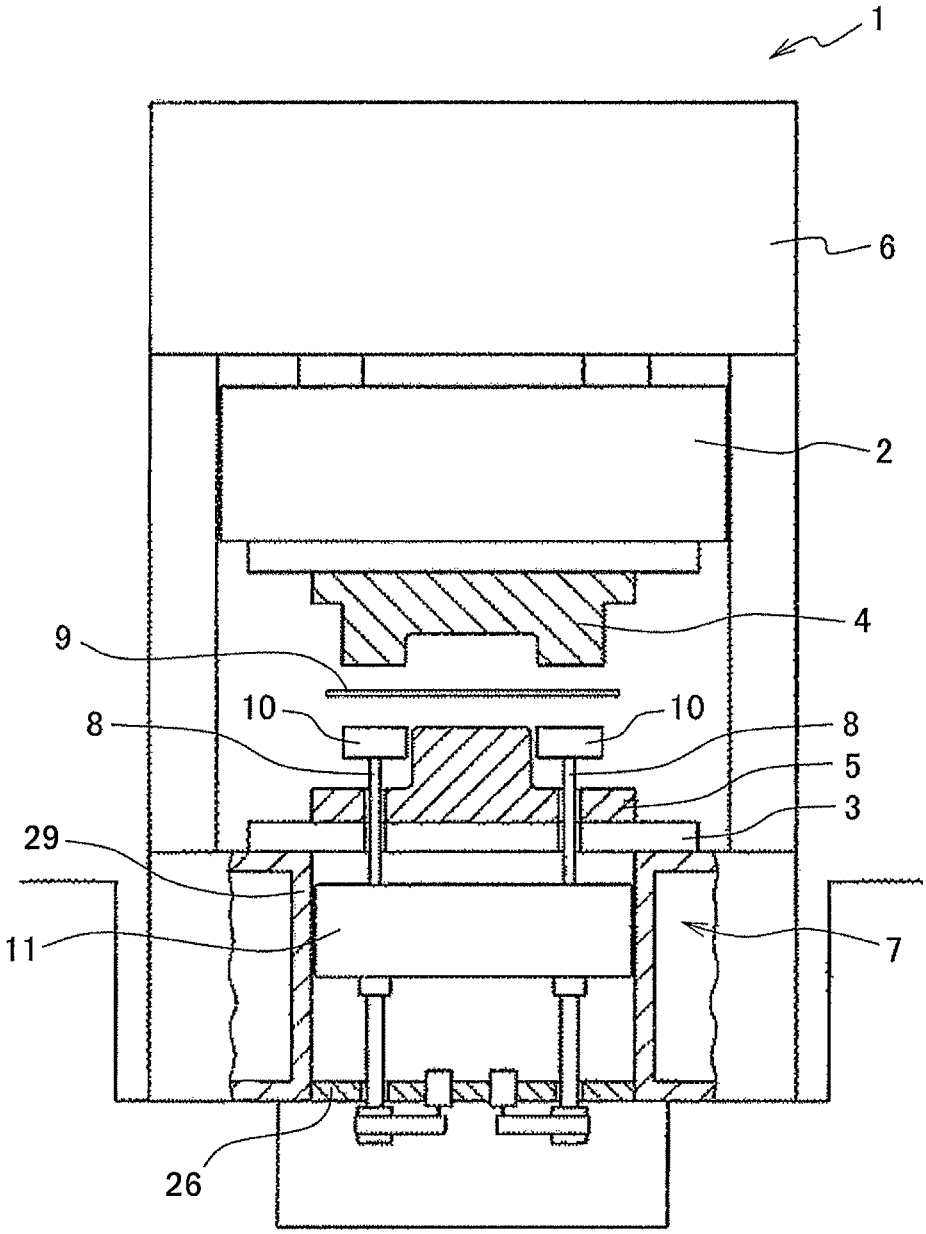
FIG. 1 is a front structural view of a press machine in accordance with an exemplary embodiment.

FIG. 1 is a schematic diagram illustrating the structure of a press machine 1 including a die cushion device 7 in accordance with the exemplary embodiment. The press machine 1 further includes a slide 2, a bolster 3, a pair of a top die 4 and a bottom die 5, and a slide drive mechanism 6.

The slide 2 is disposed while being allowed to move in a vertical direction. The bolster 3 is disposed below and opposed to the slide 2. The slide drive mechanism 6 is disposed over the slide 2. The slide drive mechanism 6 is configured to raise and lower the slide 2. The top die 4 is attached to a bottom part of the slide 2. The bottom die 5 is attached to a top part of the bolster 3. Each of the bolster 3 and the bottom die 5 includes a plurality of through holes vertically penetrating therethrough. A plurality of cushion pins 8 described below are respectively inserted into the through holes. The slide drive mechanism 6 is configured to raise and lower the slide 2 for pressing the top die 4 onto the bottom die 5. Accordingly, a processing target member (hereinafter referred to as "a work 9"), disposed between the top die 4 and the bottom die 5, is pressed therebetween and processed in a desirable shape. The die cushion device 7 is configured to generate press force towards the slide 2.

1-2. Structure of Die Cushion Device 7

Figure 2:
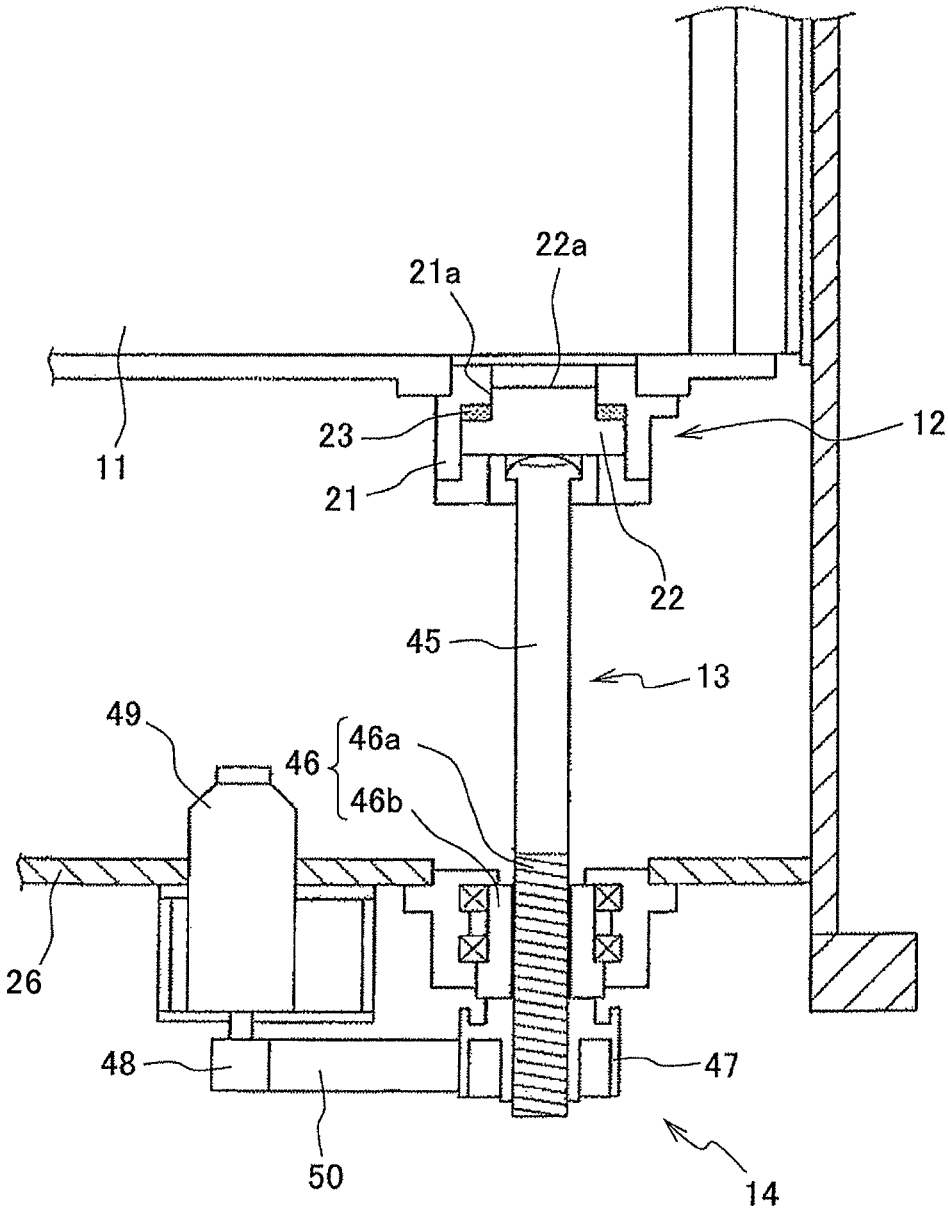
FIG. 2 is an enlarged partial structural view of a die cushion device in accordance with the exemplary embodiment.
Figure 3:
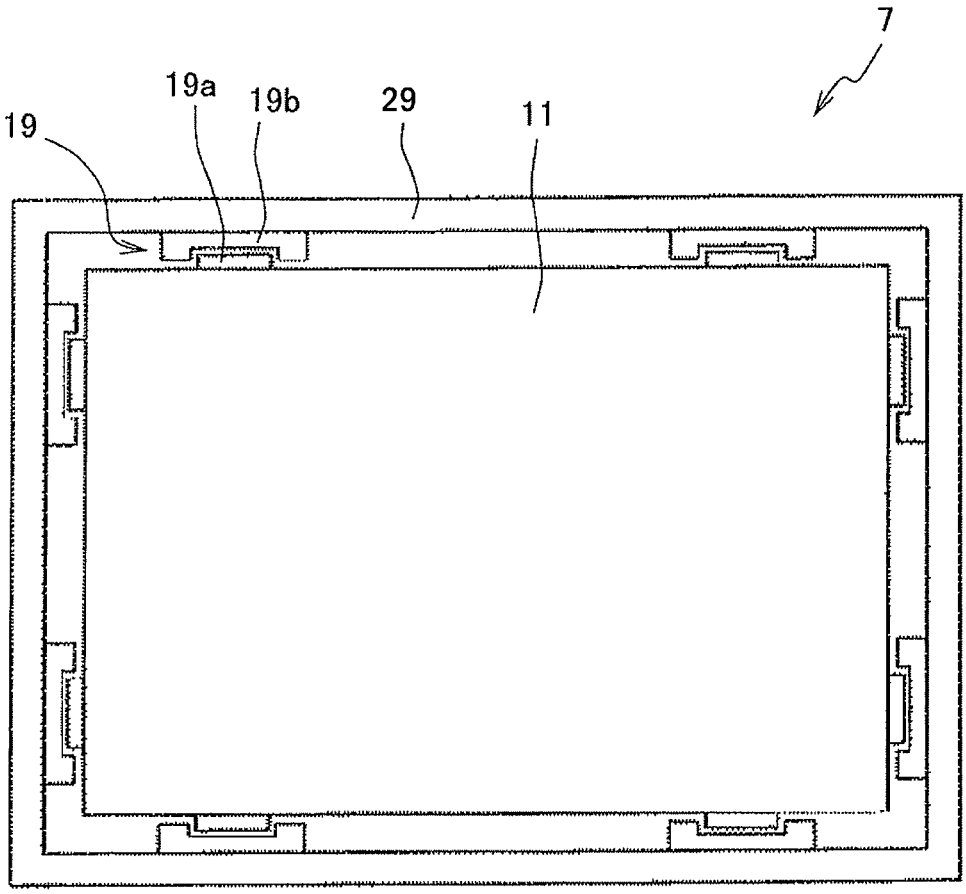
FIG. 3 is a top view of the die cushion device.

The structure of the die cushion device 7 according to the exemplary embodiment will be hereinafter explained in detail with reference to FIGS. 1 to 3. FIG. 2 is a schematic diagram of the die cushion device 7. FIG. 3 is a top view of the die cushion device 7. The die cushion device 7 includes the plural cushion pins 8, a blank holder 10, a cushion pad 11, shock absorber devices 12, support sections 13, drive sections 14, a variety of detector sections 15 to 17 (see FIG. 5), and a controller section 18 (see FIG. 5).

As illustrated in FIG. 1, each of the cushion pins 8 is inserted into each of the through holes formed in both the bolster 3 and the bottom die 5 while being allowed to move in the vertical direction. The upper ends of the cushion pins 8 are abutted to the blank holder 10, whereas the bottom ends of the cushion pins 8 are abutted to the cushion pad 11.

The blank holder 10 is disposed below the top die 4. The blank holder 10 is configured to be pressed onto the top die 4 through the work 9 when the top die 4 is downwardly moved closer to the bottom die 5.

The cushion pad 11 is a member receiving force from the slide 2. The cushion pad 11 is disposed within a bed 29 disposed under the bolster 3. The cushion pad 11 is disposed while being allowed to vertically move within the bed 29. It should be noted that a beam 26 is bridged over the opposed inner walls of the bed 29. The beam 26 supports the die cushion device 7. As illustrated in FIG. 3, plural guides 19 are disposed between every opposed pair of a lateral surface of the cushion pad 11 and an inner wall surface of the bed 29. Each guide 19 includes a pair of an inner guide 19*a* and an outer guide 19*b*. The inner and outer guides 19*a*, 19*b* are configured to be engaged. The inner guides 19*a* are disposed on the lateral surfaces of the cushion pad 11, whereas the outer guides 19*b* are disposed on the inner wall surfaces of the bed 29. The guides 19 are configured to guide the cushion pad 11 in the vertical direction. It should be noted in FIG. 3 that a reference numeral is assigned to only one of the plural guides 19 without being assigned to the rest of the guides 19.

As illustrated in FIG. 2, the shock absorber devices 12 are configured to relieve shock between the cushion pad 11 and the support sections 13. Each shock absorber device 12 includes a cylinder 21, a piston 22, and a hydraulic circuit 24 (see FIG. 4).

The cylinder 21 is attached to a bottom part of the cushion pad 11. The cylinder 21 is formed in a downwardly opened shape. The cylinder 21 includes a recess 21*a* recessed upwards. The recess 21*a* is formed as the inner ceiling within the opening.

The piston 22 is slidably contained within the cylinder 21. Further, the piston 22 includes a convex 22*a* protruded upwards. The convex 22*a* of the piston 22 is inserted into the recess 21*a* of the cylinder 21. An annular hydraulic chamber 23 (one example of a liquid pressure chamber) is formed between the cylinder 21 and the piston 22. The center axis of the hydraulic chamber 23 is matched with the center axis shared by a rod 45 and a ball screw 46 described below. The hydraulic chamber 23 is filled with oil as a shock reliever.

Figure 4:
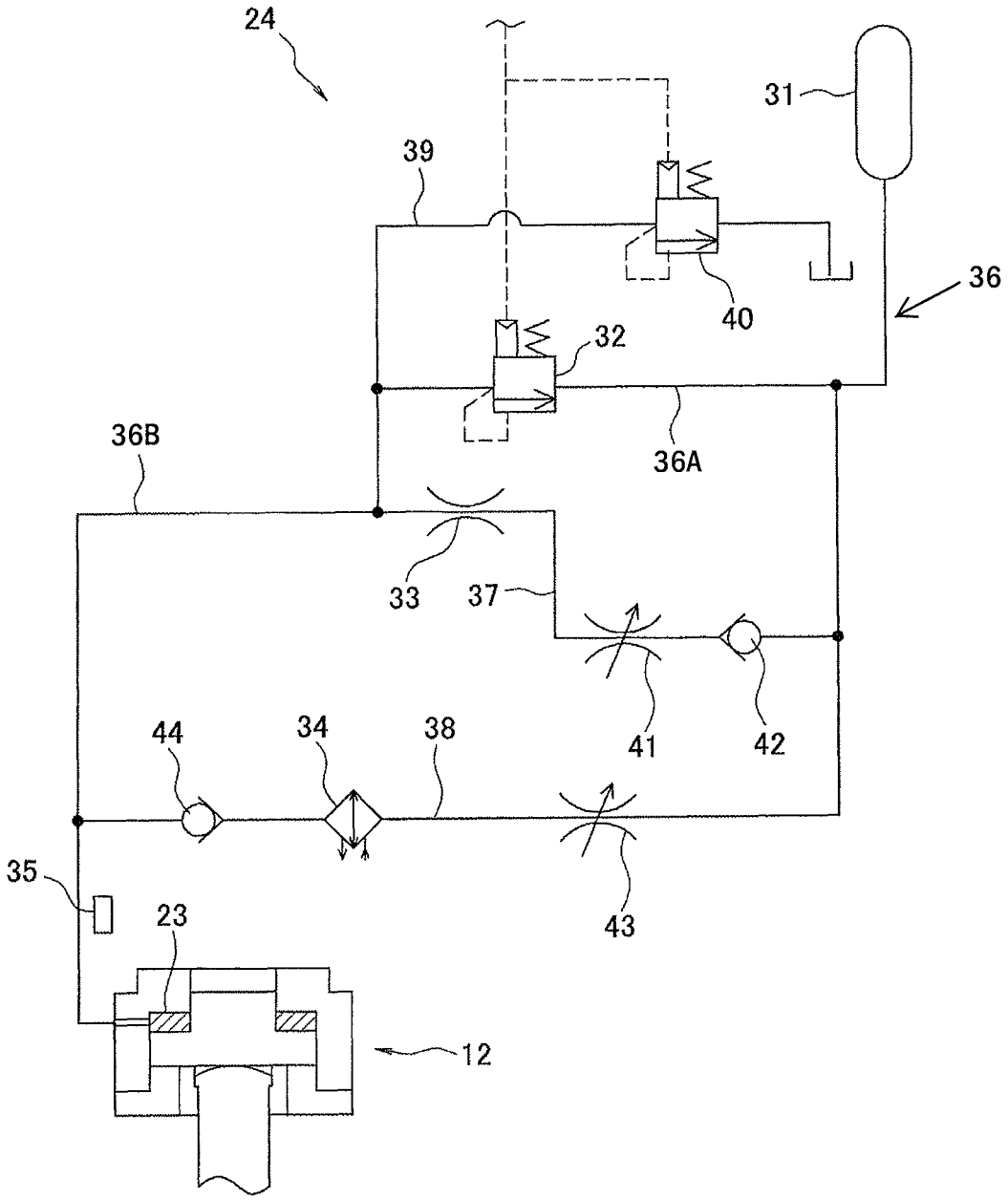
FIG. 4 is a configuration diagram of a hydraulic circuit.

FIG. 4 illustrates a schematic diagram of the configuration of the hydraulic circuit 24. The hydraulic circuit 24 is connected to the hydraulic chamber 23. The hydraulic circuit 24 is allowed to supply the oil to the hydraulic chamber 23 or discharge the oil from the hydraulic chamber 23.

The hydraulic circuit 24 includes an accumulator 31 (one example of an elastic section), a first relief valve 32, a restrictor such as an orifice 33 (one example of a damping section), a cooler 34, a second relief valve 40, a pressure sensor 35, and plural liquid flow paths 36 to 39.

The accumulator 31 is connected to the hydraulic chamber 23 through the first flow path 36. The first flow path 36 includes a first section 36A and a second section 36B. The first section 36A extends from the accumulator 31 to the first relief valve 32. The second section 36B extends from the first relief valve 32 to the hydraulic chamber 23.

The first relief valve 32 is disposed in the first flow path 36. The first relief valve 32 is configured to be opened when the hydraulic pressure of the first flow path 36 (i.e., the hydraulic pressure of the hydraulic chamber 23) is greater than or equal to a predetermined first relief pressure. The first relief pressure is set to be equal to the pressure acting on the hydraulic chamber 23 for opening the first relief valve 32 when the top die 4 and the work 9 make contact to each other.

The orifice 33 is disposed in the second flow path 37 branched from the first flow path 36. It should be noted that a variable throttle valve 41 and a check valve 42 are disposed in the second flow path 37. Accordingly, the oil is prevented from reversely flowing towards the first flow path 36.

The cooler 34 is disposed in the third flow path 38 branched from the first flow path 36. The third flow path 38 is connected to the second flow path 37 at an end thereof opposite to the other end thereof branched from the first flow path 36 closer to the hydraulic chamber 23. The cooler 34 is configured to cool the oil heated by way of passage through the orifice 33. It should be noted that a variable throttle valve 43 and a check valve 44 are disposed in the third flow path 38. Accordingly, the oil is prevented from flowing from the hydraulic chamber 23 of the first flow path 36 to the cooler 34.

The second relief valve 40 is disposed in the fourth flow path 39 branched from the first flow path 36. The fourth flow path 39 is connected to an oil tank at an end thereof opposite to the other end thereof branched from the first flow path 36. The second relief valve 40 is configured to be opened when the hydraulic pressure of the hydraulic chamber 23 is greater than or equal to a predetermined second relief pressure. The second relief pressure is set to be higher than the aforementioned first relief pressure. The second relief valve 40 is configured to be opened when the hydraulic pressure of the hydraulic chamber 23 becomes excessively high. Accordingly, an excessive load can be prevented from being applied to the cushion pad 11. It should be noted that an emergency stop is configured to be activated for the press machine 1 when the second relief valve 40 is activated. On the other hand, when the press machine 1 recovers, a hydraulic pressure supply unit (not illustrated in the figure) supplies the oil to the hydraulic circuit 24.

The pressure sensor 35 is configured to detect the hydraulic pressure of the first flow path 36 (i.e., the hydraulic pressure of the hydraulic chamber 23).

The support section 13 illustrated in FIG. 2 is configured to support the cushion pad 11. The support section 13 includes the rod 45. The upper end of the rod 45 is abutted to the lower end of the piston 22. The rod 45 includes a spherical abutment surface on the upper end thereof. Even when the cushion pad 11 is slanted, the entire rod 45 receives only axial force due to the spherical upper end thereof. The structure prevents the rod 45 from being damaged by eccentric load. The lower end of the rod 45 is connected to the upper end of a screw portion 46*a* of the ball screw 46.

The drive section 14 includes the ball screw 46, a large pulley 47, a small pulley 48, and a servomotor 49.

The ball screw 46 includes the screw portion 46*a* and a nut portion 46*b*. The screw portion 46*a* is screwed into the nut portion 46*b*. The upper end of the screw portion 46*a* is connected to the lower end of the rod 45. The lower end of the nut portion 46*b* is connected to the upper end of the large pulley 47. Further, the nut portion 46*b* is supported by the beam 26 through a bearing and the like for axially supporting the screw portion 46*a*. The small pulley 48 is connected to a revolution shaft of the servomotor 49. A belt 50 is stretched over the large pulley 47 and the small pulley 48. Accordingly, power transmission is allowed between the large pulley 47 and the small pulley 48.

The servomotor 49 includes the revolution shaft. The revolution shaft is configured to be forwardly and reversely revolved by the supply of electric current. When the revolution shaft is revolved by the supply of electric current to the servomotor 49, the small pulley 48 is rotated. Rotation of the small pulley 48 is transmitted to the large pulley 47 through the belt 50. The large pulley 47 is accordingly rotated. The large pulley 47 is herein connected to the nut portion 46*b*. Therefore, the nut portion 46*b* is rotated in conjunction with the rotation of the large pulley 47. When the nut portion 46*b* is rotated, the screw portion 46*a* is linearly moved along the nut portion 46*b* in the vertical direction. Accordingly, the rod 45 is moved in the vertical direction, and the cushion pad 11 is raised and lowered together with the piston 22, the hydraulic chamber 23, and the cylinder 21. Thus, the servomotor 49 is configured to raise and lower the support section 13 for raising and lowering the cushion pad 11.

Figure 5:
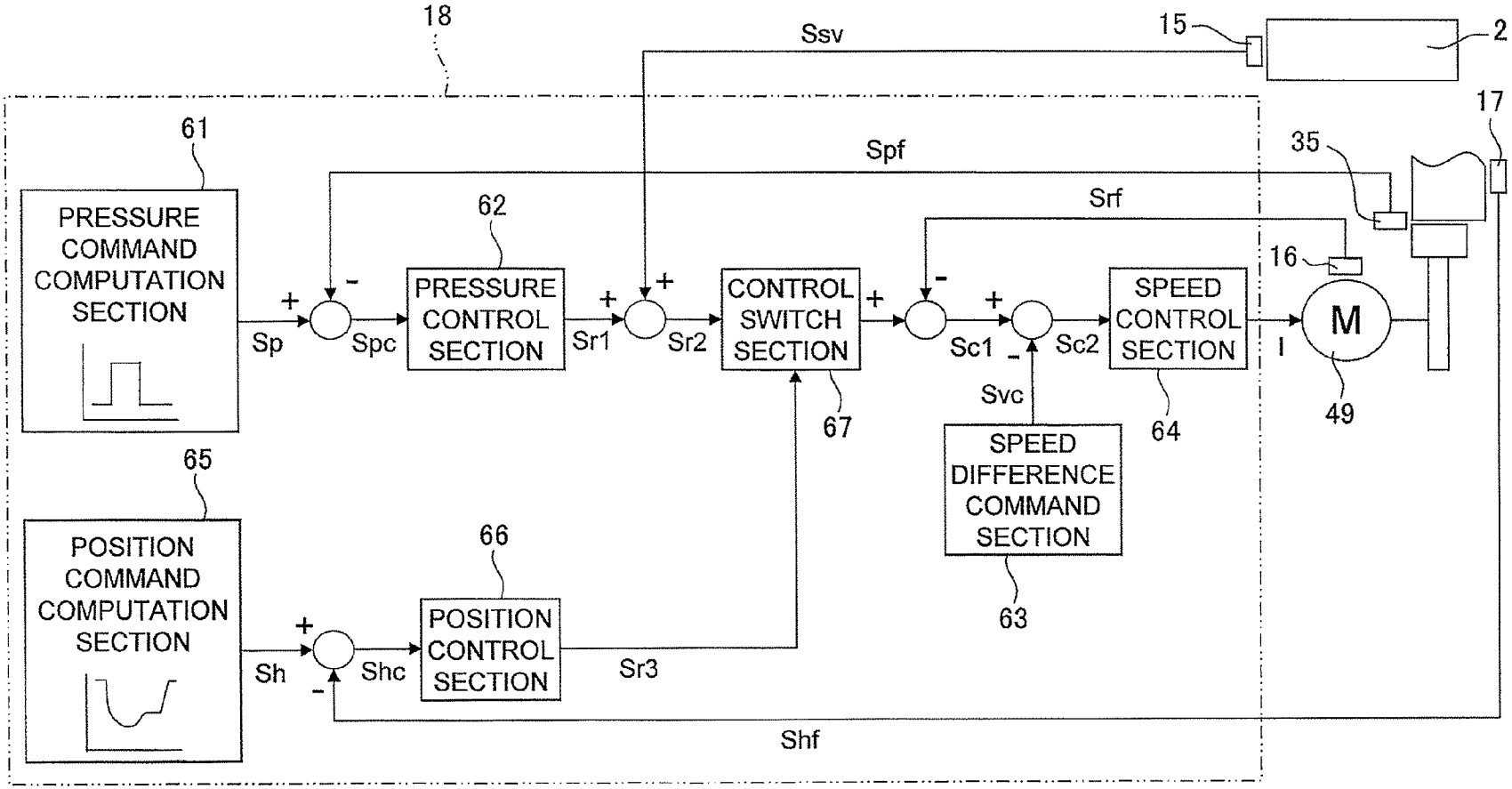
FIG. 5 is a control block diagram of the die cushion device.

As illustrated in FIG. 5, the various detector sections 15 to 17 specifically correspond to a first speed detector section 15, a second sped detector section 16, and a position detector section 17.

The first speed detector section 15 is configured to detect the speed of the slide 2.

The second speed detector section 16 is configured to detect the speed of the support section 13. For example, the second speed detector section 16 is an encoder disposed about the revolution shaft of the servomotor 49. The second speed detector section 16 is herein configured to detect the revolution speed of the servomotor 49.

The position detector section 17 is configured to detect the position of the cushion pad 11. For example, the position detector section 17 is a linear scale disposed between the cushion pad 11 and the bed 29. The position detector section 17 is herein configured to detect the raised position and the lowered position of the cushion pad 11.

The information detected by the detector sections 15 to 17 are configured to be transmitted to the controller section 18 as detection signals.

The controller section 18 is configured to control the electric current to be supplied to the servomotor 49 for controlling the servomotor 49. The controller section 18 is configured to control the servomotor 49 for controlling the position and the speed of the cushion pad 11. Yet further, the controller section 18 is configured to control press force to be applied to the slide 2 from the cushion pad 11. Control of the die cushion device 7, executed by the controller section 18, will be hereinafter explained in detail.

2. Actions of Die Cushion Device 7

2-1. Actions of Cushion Pad 11

Figure 6:
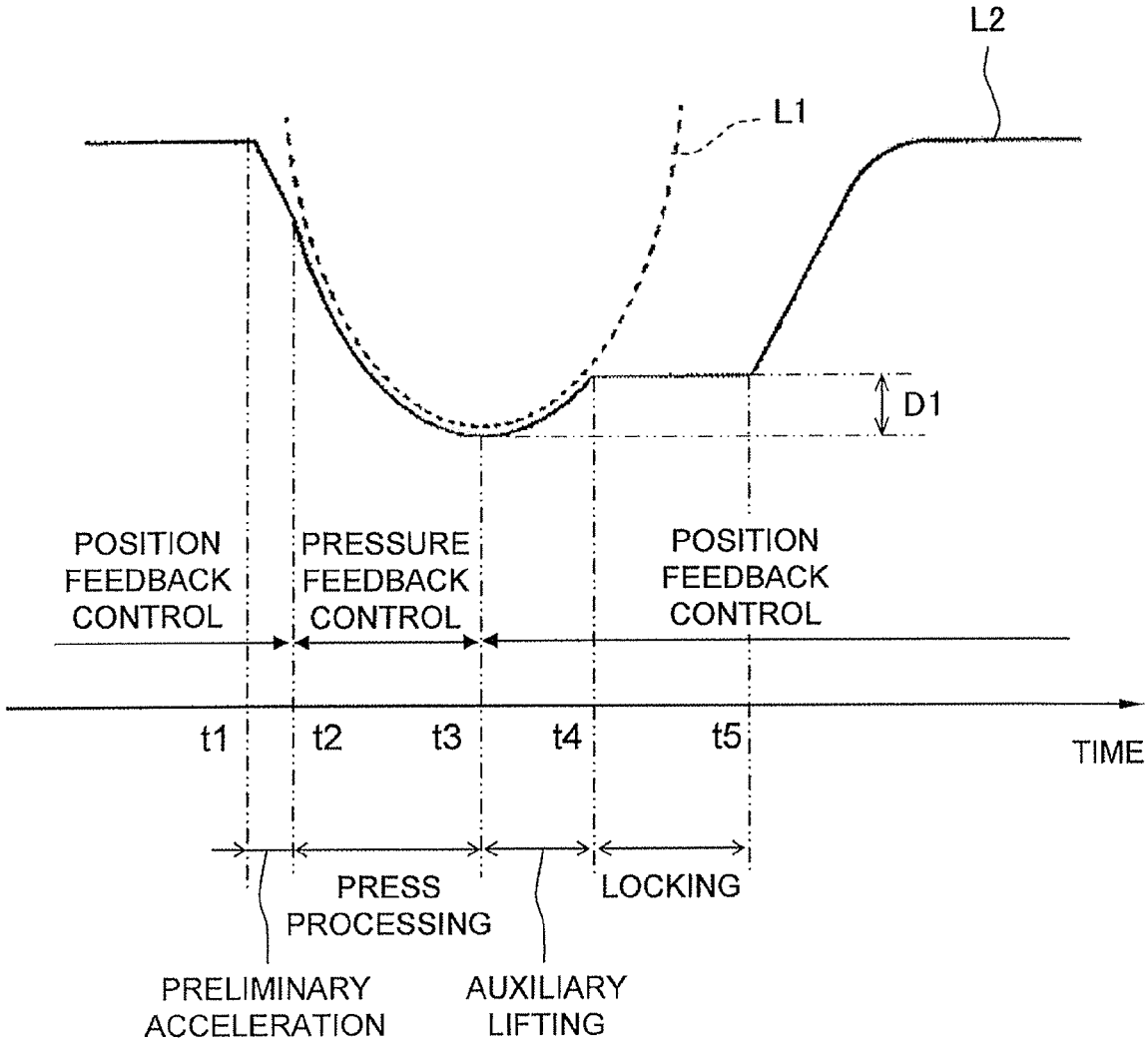
FIG. 6 is a chart showing actions of a slide and a cushion pad.

FIG. 6 is a chart showing actions of the slide 2 and the cushion pad 11. FIG. 6 also shows time-series change in positions of the slide 2 and the cushion pad 11. In FIG. 6, a dashed line L1 indicates change in position of the slide 2, whereas a solid line L2 indicates change in position of the cushion pad 11.

First, preliminarily acceleration is executed for the cushion pad 11 in a period from Time t1 to Time t2. In the preliminarily acceleration, the cushion pad 11 is preliminarily moved downwards for relieving shock to be caused when the top die 4 and the work 9 make contact to each other. The controller section 18 executes a position feedback control during the preliminarily acceleration. Specifically, the position of the cushion pad 11 is controlled under a condition that a detected value of the position of the cushion pad 11 follows a preliminarily set position pattern. The cushion pad 11 moves downwards in response to the content of the control. It should be noted that the content of the position feedback control will be hereinafter explained in detail.

At Time t2, the top die 4 and the work 9 make contact to each other. It should be noted that a term "a point-of-time of collision" and related terms thereto hereinafter refer to Time t2 when the top die 4 and the work 9 make contact to each other. In a period from Time t2 to Time t3, the slide 2 and the cushion pad 11 integrally move downwards, and the work 9 is thereby processed while being pressed therebetween. In this period, the controller section 18 executes a pressure feedback control. Specifically, load to be applied to the cushion pad 11 is controlled under a condition that a detected value of the hydraulic pressure of the hydraulic chamber 23 follows a preliminarily set pressure pattern. The cushion pad 11 moves downwards in response to the content of the control. It should be noted that the content of the pressure feedback control will be hereinafter explained in detail.

At Time t3, the slide 2 and the cushion pad 11 reach the bottom dead center. In a period from Time t3 to Time t4, the slide 2 and the cushion pad 11 integrally raised by an auxiliary lifting stroke D1.

In a period from Time t4 to Time t5, the cushion pad 11 is locked and temporarily halted from being raised. At Time t5, the cushion pad 11 starts being raised again.

It should be noted that the controller section 18 executes the position feedback control in a period from Time t3 to Time t5. Specifically, the position of the cushion pad 11 is controlled under a condition that a detected value of the position of the cushion pad 11 follows a preliminarily set position pattern. The cushion pad 11 is configured to be raised in response to the content of the control.

2-2. Actions of Shock Absorber Device 12

When the top die 4 makes contact to the work 9 in conjunction with downward movement of the slide 2, force is transmitted from the slide 2 to the cushion pad 11 through the top die 4, the work 9, the blank holder 10, and the cushion pins 8. The oil filled in the hydraulic chambers 23 herein absorbs force instantly acting on the cushion pad 11. Therefore, the shock absorber devices 12 relieve the load instantly applied to the cushion pad 11 by the slide 2 at the point-of time of collision. Actions of each shock absorber device 12 of the case will be hereinafter explained.

As described above, the cushion pad 11 and the support section 13 are moving downwards by means of the preliminary acceleration immediately before the contact between the top die 4 and the work 9. When the top die 4 and the work 9 make contact to each other and load is accordingly applied to the cushion pad 11 by the slide 2, the cushion pad 11 is downwardly moved relative to the support section 13. The hydraulic chamber 23 is accordingly compressed and the oil contained therein is transferred to the hydraulic circuit 24.

With reference to FIG. 4, the oil, transferred to the hydraulic circuit 24, passes through the first flow path 36 and is then transferred to the accumulator 31. The accumulator 31 accordingly causes the shock absorber device 12 to generate reaction force in response to the relative displacement of the cushion pad 11 with respect to the support section 13. Further, the oil, transferred to the hydraulic circuit 24, passes through the second flow path 37 and passes through the orifice 33. The orifice 33 thereby causes the shock absorber device 12 to generate reaction force in response to the relative speed of the cushion pad 11 with respect to the support section 13. Resultant force of the reaction force by the accumulator 31 and the reaction force by the orifice 33 consequently acts on the cushion pad 11 as load. It should be noted that the oil contained in the accumulator 31 is returned to the hydraulic chamber 23 when load is released after Time t4.

Figure 7:
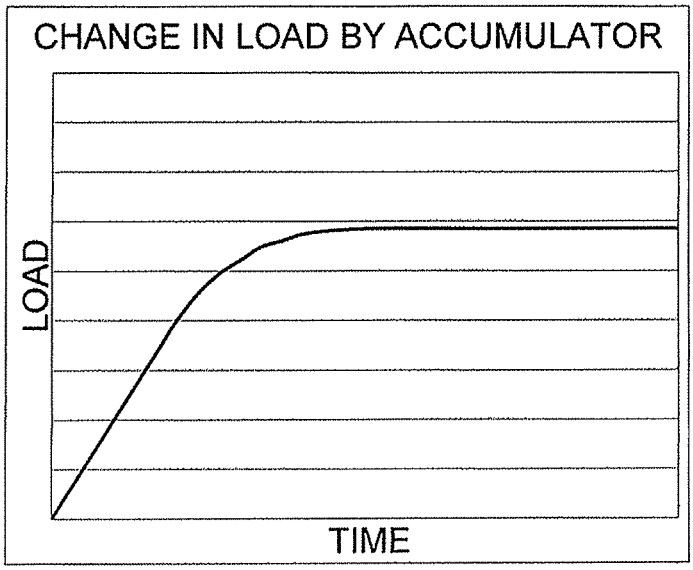
FIG. 7 is composed of a chart showing change in load by an accumulator and a chart showing change in load by an orifice.
Figure 7:
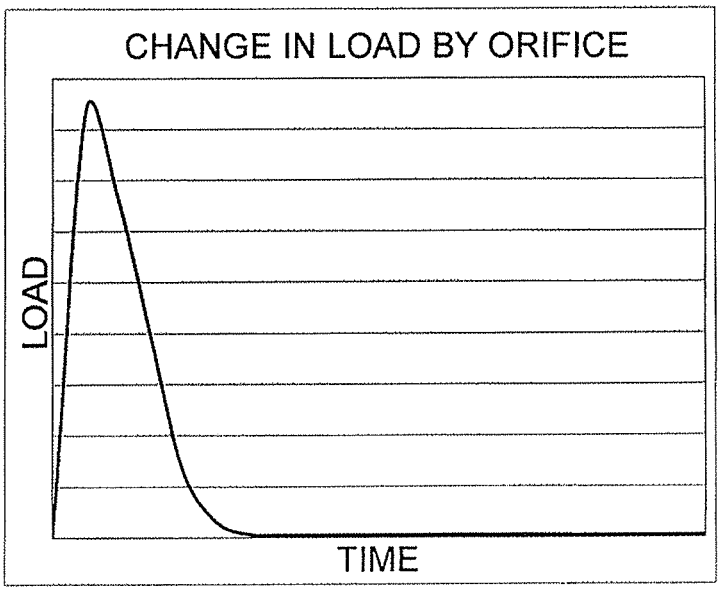

FIG. 7(*a*) shows an example of time-series change in load by the accumulator 31. The accumulator 31 has a relatively low spring constant. Load slowly rises but monotonically increases to a target load without being overshooting.

On the other hand, FIG. 7(*b*) shows an example of time-series change in load by the orifice 33. In the initial phase of collision, the relative speed will be relatively high due to the contact between the top die 4 and the work 9. Therefore, the load by the orifice 33 highly increases in the initial phase of collision and immediately thereafter converges to zero.

Figure 8:
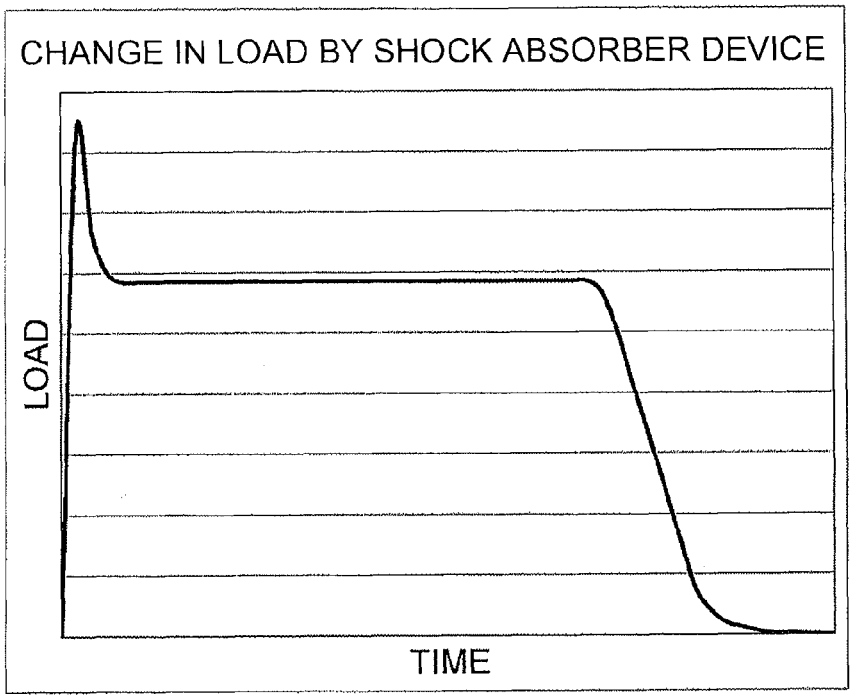
FIG. 8 is a chart showing change in load by a shock absorber device.

As described above, the resultant force of the load by the accumulator 31 and the load by the orifice 33 acts on the cushion pad 11. Therefore, time-series change in load acting on the cushion pad 11 is expressed with a type of waveform shown in FIG. 8. In the change in load, load rises very quickly and is also stabilized quickly after rising.

3. Control of Die Cushion Device 7

Next, control of the die cushion device 7, executed by the controller section 18, will be explained with reference to FIG. 5. The controller section 18 includes a pressure command computation section 61, a pressure control section 62, a speed difference command section 63, a speed control section 64, a position command computation section 65, a position control section 66, and a control switch section 67. The following controls, i.e., the pressure feedback control and the positional feedback control, will be selectively executed by the functions of the aforementioned sections. It should be noted that FIG. 5 is a control block diagram illustrating the feedback control to be executed by the controller section 18.

3-1. Pressure Feedback Control

First, the pressure feedback control will be explained.

The pressure command computation section 61 stores a pressure pattern indicating a desirable relation between time and pressure acting on the cushion pad 11 (hereinafter referred to as "cushion pressure"). The pressure command computation section 61 is configured to obtain the cushion pressure corresponding to time based on the pressure pattern and output the obtained cushion pressure as a pressure control signal Sp.

Meanwhile, the pressure sensor 35 is configured to detect the hydraulic pressure of the hydraulic chamber 23 and output the value of the detected hydraulic pressure as a pressure feedback signal Spf. Then, a pressure correction signal Spc is generated by subtracting the value of the pressure feedback signal Spf from the value of the pressure control signal Sp. The pressure control section 62 is configured to compute the appropriate speed of the servomotor 49 based on the pressure correction signal Spc and output the computed speed as a motor speed control signal Sr1.

Further, the first speed detector section 15 is configured to detect the speed of the slide 2 and output the value of the detected speed as a slide speed signal Ssv. Then, a motor speed command signal Sr2 is generated by adding the value of the slide speed signal Ssv to the value of the motor speed control signal Sr1.

Meanwhile, the second speed detector section 16 is configured to detect the speed of the support section 13 and output the value of the detected speed as a speed feedback signal Srf. Then, a first speed correction signal Sc1 is generated by subtracting the value of the speed feedback signal Srf from the value of the motor speed command signal Sr2.

Figure 9:
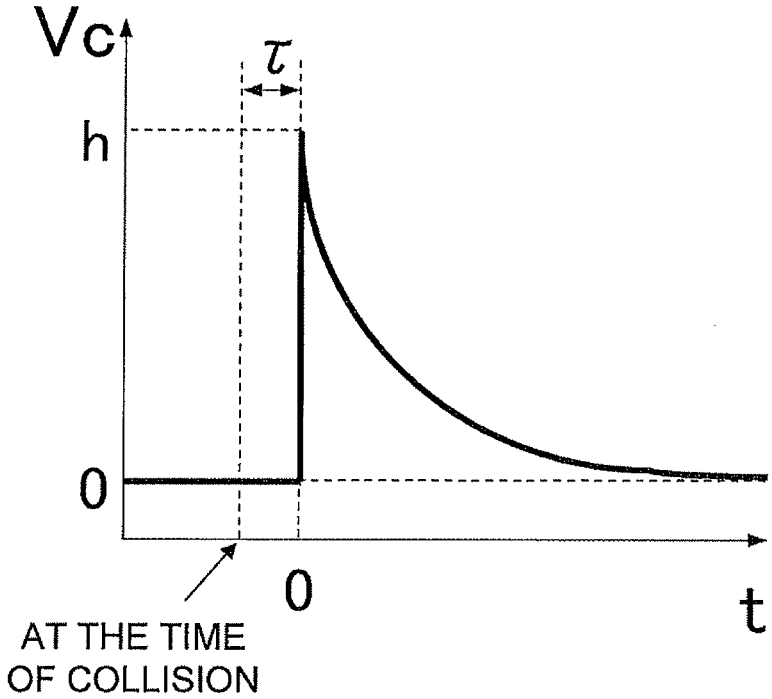
FIG. 9 is a chart showing change in a speed difference command value.

Next, the speed difference command section 63 is configured to output a speed difference command signal Svc. Then, a second speed correction signal Sc2 is generated by subtracting the value of the speed difference command signal Svc from the value of the first speed correction signal Sc1. The speed difference command signal Svc is herein a signal for controlling the servomotor 49 to generate a predetermined speed difference between the speed of the slide 2 and the speed of the support section 13. Specifically, the speed difference command section 63 stores a type of the speed difference pattern shown in FIG. 9. The speed difference command section 63 is configured to obtain speed difference corresponding to time based on the speed difference pattern and output the obtained speed difference as the speed difference command signal Svc.

Figure 10:
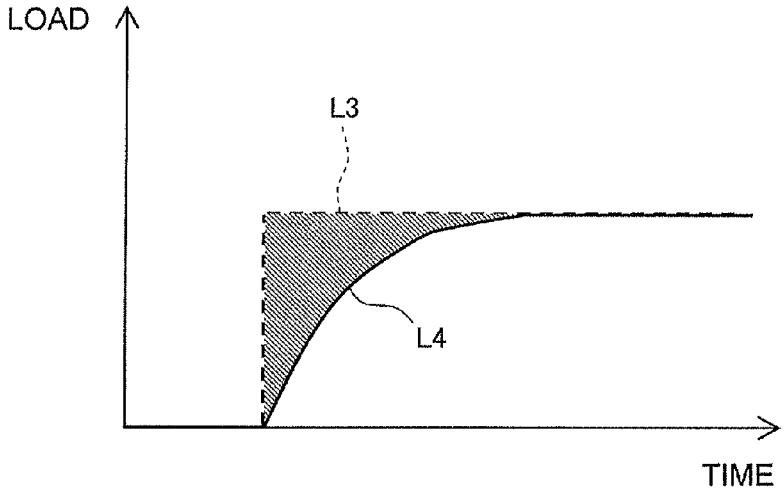
FIG. 10 is a chart showing change in load by the accumulator and change in a target load.

In the speed difference pattern, the speed difference peaks at a first point-of-time after the point-of-time of collision and thereafter decreases over time. The shape of the speed difference pattern corresponds to ideal damping force illustrated in FIG. 10 (see a crosshatched portion in FIG. 10). In FIG. 10, a dashed line L3 indicates the target load of the cushion pad 11 at the point-of-time of collision, whereas a solid line L4 indicates change in load to be generated by the accumulator 31 of the shock absorber device 12 at the point-of-time of collision. In other words, the ideal damping force is a difference between the target load and the load by the accumulator 31. Further, the aforementioned speed difference pattern is set for getting the damping force by the orifice 33 of the shock absorber device 12 to be equal to the ideal damping force.

For example, the speed difference pattern can be expressed with the following equation.

$$\begin{cases} Vc = 0 & (t < 0) \\ Vc = he^{-Bt} & (t \geq 0) \end{cases} \quad \text{Equation 1}$$

Equation 1 is herein set where "Vc" is a speed difference command value; "t" is time; "h" is peak height; "B" is time constant; and "τ" is time delay. It should be noted that the origin is set as a point-of-time delayed from the point-of-time of collision by a period of time "τ".

Further, the aforementioned "h", "B", and "τ" are expressed as functions of "v" (collision speed), "F" (press force), "V0" (initial volume of the accumulator 31), "P0" (initial pressure of the accumulator 31), and "SPM" (molding cycle frequency) as follows.

$$h=f(v,F,V0,P0,SPM)$$

$$B=g(v,F,V0,P0,SPM)$$

$$\tau=h(v,F,V0,P0,SPM) \quad \text{Equation 2}$$

The collision speed v herein indicates the relative speed of the slide 2 with respect to the cushion pad 11 at the point-of-time of collision. The press force F indicates force to be applied to the slide 2 by the cushion pad 11. The initial volume V0 of the accumulator 31 indicates the gas volume within the accumulator 31 before the point-of-time of collision. The initial pressure P0 of the accumulator 31 indicates the gas pressure within the accumulator 31 before the point-of-time of collision, i.e., the pressure of the oil contained in the accumulator 31. The molding cycle frequency SPM indicates frequency of molding per a unit time (e.g., a minute), i.e., frequency of reciprocation of the slide 2 per a unit time.

With reference back to FIG. 5, the second speed correction signal Sc2 is outputted to the speed control section 64. The speed control section 64 is configured to compute a value of appropriate electric current to be supplied to the servomotor 49 based on the second speed correction signal Sc2. The value of electric current is supplied to the servomotor 49 as a supply current I. The servomotor 49 is configured to drive the cushion pad 11 with the supply current I. The cushion pad 11 moves downwards while generating upward press force with respect to the slide 2. Consequently, the cushion pressure set as above is obtained.

3-2. Position Feedback Control

Next, the position feedback control will be explained.

The position command computation section 65 stores a position pattern showing a desirable relation between time and the position of the cushion pad 11. The position command computation section 65 is configured to obtain the position of the cushion pad 11 corresponding to time based on the position pattern and output the obtained position as a position control signal Sh.

Meanwhile, the position detector section 17 is configured to detect the height position of the cushion pad 11 and output the detected height position as a position feedback signal Shf. Then, a position correction signal Shc is generated by subtracting the value of the position feedback signal Shf from the value of the position control signal Sh. The position correction signal Shc is outputted to the position control section 66. The position control section 66 is configured to compute the appropriate speed of the servomotor 49 based on the position correction signal Shc and output a motor speed control signal Sr3. Subsequent signal flow is the same as that in the pressure feedback control. It should be noted that the value of the speed difference command signal Svc from the speed difference command section 63 is set to be zero during execution of the position feedback control.

It should be noted that the control switch section 67 is configured to switch between the pressure feedback control and the position feedback control.

4. Features

In the die cushion device 7, the shock absorber device 12 includes both the accumulator 31 and the orifice 33. Therefore, press force to the top die 4 by the work 9 can be stabilized at the point-of-time of collision. Further, the orifice 33 compensates slow rising of the press force by the accumulator 31. The rise time of the press force can be thereby reduced.

Further in the die cushion device 7, the difference between the speed of the slide 2 and the speed of the support section 13 is controlled so that the orifice 33 compensates slow rising of the press force by the accumulator 31. Accordingly, the press force generated at the point-of-time of collision can be accurately controlled.

5. Other Exemplary Embodiments (a) In the aforementioned exemplary embodiment, the shock absorber devices 12 include the hydraulic circuit 24, and shock is absorbed by the hydraulic pressure. However, any other shock absorber elements may be used. For example, a damper as a damping section may be disposed instead of the orifice 33. Further, a coil spring as an elastic section may be disposed instead of the accumulator 31.

(b) In the aforementioned exemplary embodiment, the speed of the slide 2 is detected, and the difference between the speed of the slide 2 and the speed of the support section 13 is controlled. However, the speed of the cushion pad 11 may be detected and used, while being regarded as the aforementioned speed of the slide 2.

(c) The speed difference pattern may not be limited to the above. For example, any other suitable patterns may be used as long as they compensate slow rising of the press force by the accumulator 31.

(d) In the aforementioned exemplary embodiment, the oil is used in each shock absorber device 12. However, any suitable liquids, excluding the oil, may be used as long as they can absorb shock.

(e) In the aforementioned exemplary embodiment, the orifice 33 is used. However, any other suitable devices may be used as long as they function as restrictors.

(f) The first speed detector section 15 may be a unit configured to detect the position of the slide and differentiate the value of the detected position for obtaining the speed of the slide.

Further, the second speed detector section 16 may be configured to detect the revolution angle of the revolution shaft of the servomotor 49 and differentiate the value of the detected revolution angle for obtaining the revolution speed of the servomotor 49.

The present invention has an advantageous effect of reducing a rise time of press force applied to a slide. Therefore, the present invention is useful for a die cushion device.

The invention claimed is:

1. A die cushion device comprising:

a cushion pad;

a support section supporting the cushion pad;

a servomotor configured to raise and lower the support section for raising and lowering the cushion pad, the servomotor being part of a drive section that includes a ball screw and at least one pulley; and a shock absorber device configured to relieve a shock between the cushion pad and the support section, the shock absorber device including a liquid pressure chamber filled with a liquid, the liquid pressure chamber being disposed between the cushion pad and the support section, a liquid flow path allowing the liquid to pass therethrough, the liquid flow path being connected to the liquid pressure chamber, an orifice disposed in the liquid flow path, and configured to generate a reaction force in accordance with a relative speed of the cushion pad with respect to the support section by restricting the liquid flow path, an accumulator disposed in the liquid flow path, and configured to generate a reaction force in accordance with a relative displacement of the cushion pad with respect to the support section; and a check valve provided in the liquid flow path between the orifice and the accumulator, the check valve being connected in series with respect to the orifice and arranged to prevent a reverse flow of the liquid from the accumulator toward the liquid pressure chamber through the orifice, the orifice and the accumulator being arranged in the liquid flow path such that the liquid flows from the liquid pressure chamber to the accumulator and through the orifice and the check valve when the shock occurring between the cushion pad and the support section causes the liquid pressure chamber to be compressed.

2. The die cushion device according to claim 1, wherein the liquid pressure chamber has an annular shape;

a center axis of the liquid pressure chamber is coincident with a center axis of the ball screw.

3. The die cushion device according to claim 1, wherein the shock absorber device includes a piston and a cylinder, the liquid pressure chamber being disposed between the piston and the cylinder;

the support section includes a rod having an upper end arranged abutted against a lower end of the piston, and having a lower end connected to the ball screw; and the servomotor includes a rotary shaft coupled to the ball screw through the at least one pulley such that rotation of the rotary shaft is transmitted to the ball screw, the piston and the cylinder being arranged between the cushion pad and the upper end of the rod.

4. The die cushion device according to claim 3, wherein the upper end of the rod has a spherical abutment surface.

5. The die cushion device according to claim 3, wherein the liquid pressure chamber has an annular shape;

a center axis of the liquid pressure chamber is coincident with a shared center axis of the ball screw and the rod.

* * * * *